United States Patent [19]

Suzuki et al.

[11] Patent Number: 4,720,731

[45] Date of Patent: Jan. 19, 1988

[54] DEVICE FOR SUPPLYING DEVELOPING SOLUTION

[75] Inventors: Shigeru Suzuki, Kanagawa; Tuneo Kurotori, Tokyo; Manabu Mochizuki, Kanagawa, all of Japan

[73] Assignee: Ricoh Company, Ltd., Tokyo, Japan

[21] Appl. No.: 745,489

[22] Filed: Jun. 17, 1985

[51] Int. Cl.[4] ..... G03G 15/10

[52] U.S. Cl. ..... 355/10; 118/661

[58] Field of Search ..... 355/3 R, 10; 354/317, 354/318; 118/659, 660, 661

[56] References Cited

U.S. PATENT DOCUMENTS

| | | | |
|---|---|---|---|
| 3,369,523 | 2/1968 | Naumann | 118/659 |
| 3,667,428 | 6/1972 | Smith | 355/10 X |
| 3,748,126 | 7/1973 | Ferguson et al. | 355/10 X |
| 3,783,827 | 1/1974 | Fukushima et al. | 355/10 X |
| 3,907,423 | 9/1975 | Hayashi et al. | 355/10 |
| 3,940,782 | 2/1976 | Neeb et al. | 354/318 |
| 3,943,541 | 3/1976 | Hirafuji | 355/10 X |
| 4,161,360 | 7/1979 | Smith | 355/10 |
| 4,392,742 | 7/1983 | Landa | 355/10 X |
| 4,640,605 | 2/1987 | Ariyama et al. | 355/10 X |

FOREIGN PATENT DOCUMENTS

| | | | |
|---|---|---|---|
| 54-45141 | 4/1979 | Japan | 355/10 |
| 55-69175 | 5/1980 | Japan | 355/10 |

*Primary Examiner*—Fred L. Braun

*Attorney, Agent, or Firm*—Oblon, Fisher, Spivak, McClelland & Maier

[57] ABSTRACT

A device for supplying a developing solution in a wet-type electrophotographic copying machine has a scraper pressed against a developing roller positioned in confronting relation to a latent-image carrier or photosensitive drum. The scraper and the developing roller jointly form a space of a V-shaped cross section which serves to form a pool of the developing solution. When the developing roller is rotated, the developing solution is drawn upwardly out of the solution pool and uniformly covers the circumferential surface of the developing roller whereupon it is transferred to the latent-image carrier. The apparatus provides a simple way of eliminating air bubbles from the developing solution before it is applied to the latent-image carrier and for applying the developing solution uniformly to the surface of the latent-image carrier.

20 Claims, 3 Drawing Figures

DEVICE FOR SUPPLYING DEVELOPING SOLUTION

BACKGROUND OF THE INVENTION

1. Field of the Invention

The present invention relates to a device for supplying a developing solution to the circumferential surface of a latent-image carrier in a wet-type electrophotograhic copying machine.

2. Discussion of the Background

Wet-type electrophotography is known in which an elestrostatic image carried on a latent-image carrier such as a photosenstive drum is visualized by a developing solution supplied to the circumferential surface of the latent-image carrier. One known arrangement for supplying the developing solution to the latent-image carrier is disclosed in Japanese Laid-Open Patent Publication No. 57-20056.

In the disclosed supplying device, the developing solution is ejected from a supply nozzle onto a guide plate from which it flows down to the latent-image carrier. The developing solution then flows down the circumferential surface of the latent-image carrier to form a solution pool between the latent-image carrier and a developing roller disposed adjacent thereto.

Another conventional developing solution supplying device has a supply nozzle opening above a region where a latent-image carrier and a developing roller are disposed in confronting relation to each other. The developing solution ejected from the supply nozzle directly forms a solution pool between the latent-image carrier and the developing roller.

In the above prior solution supplying arrangements, the developing solution is supplied from the solution pool through a small gap between the latent-image carrier and the developing roller uniformly onto the circumferential surface of the latent-image carrier.

When the electrophotographic system starts to operate, air bubbles tend to be trapped in the developing solution discharged from the nozzle due to air present in the supply tube. Air bubbles are also liable to be produced in the developing solution when it is deteriorated. In addition, since the developing solution is forcibly ejected from the nozzle and impinges upon the guide plate, the solution pool between the latent-image carrier and the developing roller contains many air bubbles, which lower the developing ability of the developing solution and degrade the quality of developed images.

The amount of the pooled developing solution is greater in the vicinity of the nozzle and becomes smaller in a direction away from the nozzle. If the developing solution were supplied in a larger quantity from the nozzle, then the pump for feeding the developing solution would be heated to cause a temperature rise of the developing solution, and an increased amount of developing solution would be directly applied to a localized surface portion of the latent-image carrier, with the result that no uniform images would be produced. Stated otherwise, surface portions of the latent-image carrier which are close to and remote from the nozzle would be supplied with different amounts of developing solution, resulting in image density irregularities.

SUMMARY OF THE INVENTION

It is an object of the present invention to provide a device for supplying a developing solution, which has a simple means for eliminating air bubbles from the developing solution before it is applied to a latent-image carrier, and which can supply the developing solution uniformly to the circumferential surface of the latent-image carrier.

According to the present invention, a developing solution is initially pooled between a developing roller and a scraper, and then transferred by the developing roller to a latent-image carrier. Air bubbles can therefore be eliminated before the developing solution reaches the latent-image carrier. Since the developing solution between the latent-image carrier and the developing roller forms a uniform solution pool, images of uniform quality can easily be produced which are free from image density irregularities and blurs.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
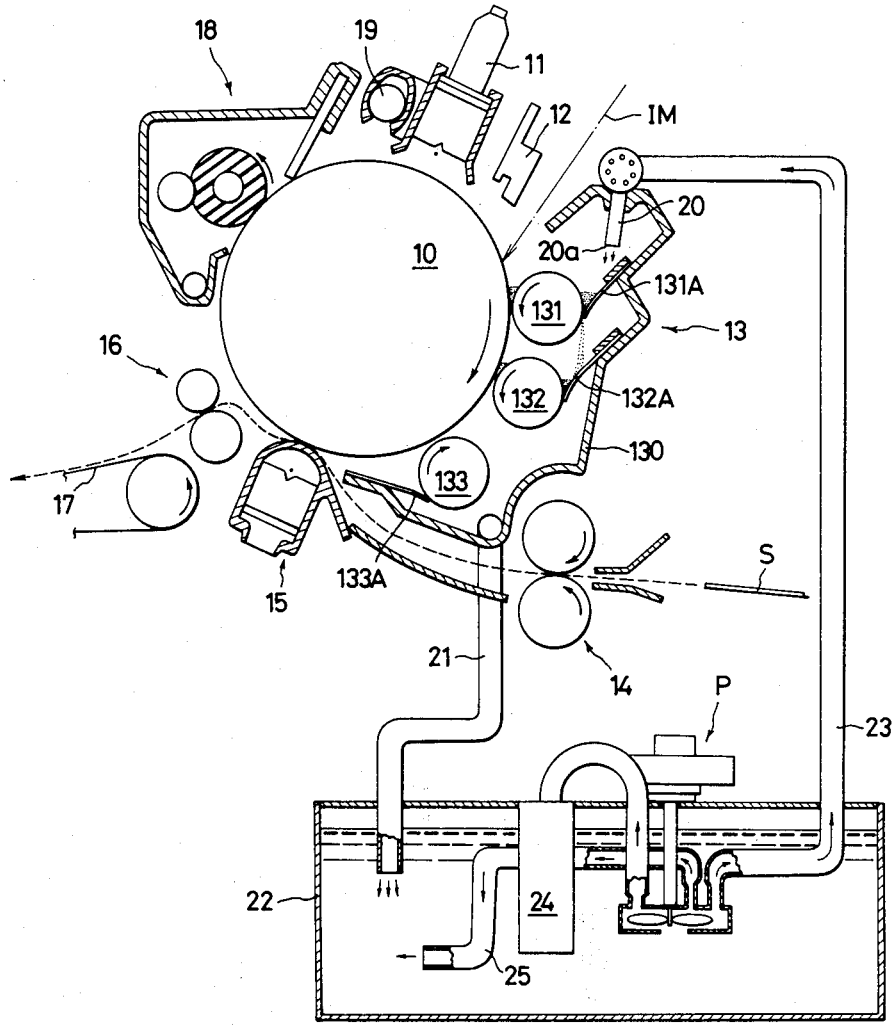
FIG. 1 is a vertical cross-sectional view of an image-transfer-type electrophotographic machine in which a developing solution supply device according to the present invention is incorporated.

The principles of the present invention will be described as being incorporated in a wet-type image-transfer electrophotographic copying machine. The electrophotographic copying machine has a rotatable photosensitive drum or latent-image carrier and a developing roller spaced a small clearance therefrom. The developing roller is driven to rotate for developing an electrostatic latent image on the latent-image carrier with a developing solution. The developing roller is cleaned by a scraper which also serves to keep the developing solution in a pool.

A copying process in the electrophotographic copying machine will first be described with reference to FIG. 1.

During a copying cycle, a photosensitive drum or latent-image carrier 10 is rotated about its own axis at a constant speed by a suitable drive means (not shown) clockwise in the direction of the arrow. After the latent-image carrier 10 has been uniformly charged by a main charger 11, the image IM of an original to be duplicated is projected by an exposure unit (not shown) onto the charged surface of the latent-image carrier 10. The surface of the latent-image carrier 10 except the region where the image is formed is discharged by an eraser 12.

The electrostatic latent image on the latent-image carrier 10 is then visualized by a developing solution containing toner in wet-type developing device 13 to which the present invention is applied. The visualized image is then transferred by a transfer charger 15 onto a sheet S fed in the direction of the dotted-line arrow through fed rollers 14 from a sheet feeder (not shown).

The sheet S to which the image has been transferred is separated from the latent-image carrier 10 by a separation roller assembly 16. The sheet S is then conveyed by a conveyor roller 17 to a fixing unit (not shown) in which the toner image is fixed to the sheet S. The sheet S is finally discharged out of the copying machine.

After the sheet S has been separated from the latent-image carrier 10, any residual toner is removed from the latent-image carrier 10 by a cleaning unit 18. Then, any residual potential is erased from the latent-image carrier 10 by an erase lamp 19 (which may be an eraser unit or an erase charger) for conditioning the latent-image carrier 10 in readiness for a next copying cycle.

The wet-type developing device 13 will now be described in detail.

The wet-type developing device 13 includes a first developing roller 131, a second developing roller 132 disposed below the first developing roller 131, and a squeeze roller 133 disposed below the second developing roller 132. These rollers 131, 132, 133 are rotatably supported in a container or casing 130 in vertically spaced-apart relation and located in a region where the circumferential surface of the latent-image carrier 10 moves downwardly. The first and second developing rollers 131, 132 have primary and secondary image developing capabilities. The first and second developing rollers 131, 132 are spaced small clearances from the circumferential surface of the latent-image carrier 10, the clearances being selected to be of 0.1 mm, for example. The first and second rollers 131, 132 are driven by a driver unit (not shown) to rotate counterclockwise in the direction of the arrows (i.e., to rotate in the sense opposite from the sense of rotation of the latent-image carrier). The wet-type developing device 13 also has first and second scrapers 131A, 132A having ends fixed to the container 130 and opposite distal ends pressed against the first and second developing rollers 131, 132, respectively, along their entire axial lengths for pooling the developing solution between the scrapers 131A, 132A and the developing rollers 131, 132 and clearing the developing solution off the developing rollers 131, 132.

The first and second scrapers 131A, 132A extend longitudinally along the first and second developing rollers 131, 132, respectively. The distal or free ends of the first and second scrapers 131A, 132A are pressed against the circumferential surfaces of the first and second developing rollers 131, 132, respectively, at such an angle that there are defined spaces of a substantially V-shaped cross section between the scrapers 131A, 132A and the developing rollers 131, 132. Therefore, the scrapers 131A, 132A are oriented in a direction opposite to the direction in which the developing rollers 131, 132 are rotated. The developing solution is pooled in such spaces, and the pooled developing solution will hereinafter be referred to as a "solution pool".

Figure 2:
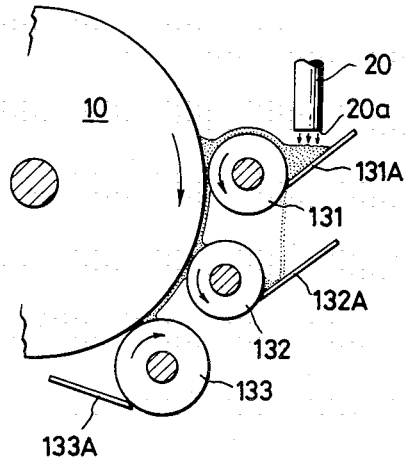
FIG. 2 is an enlarged fragmentary side elevational view of a wet-type developing device.

A developing solution supply nozzle 20 supported on the container 130 has an opening **20*a* positioned closely to the fixed end of the first scraper 131A, as shown in FIG. 1, for supplying the developing solution so as not to trap air bubbles in the solution pools. Alternatively, the opening 20*a* of the supply nozzle 20 may be disposed closely tot he solution pool as illustrated in FIG. 2, or may be immersed in the solution pool. The developing solution may also be guided from the nozzle opening 20*a*** to the solution pool by a suitable guide member.

With the nozzle opening **20*a*** thus positioned, air bubbles are reduced which would otherwise be formed by splashes produced upon flowing of the developing solution into the solution pool.

Most of air bubbles which are nonetheless formed are eliminated with time in the solution pool by the time the developing solution is fed out of the solution pool by the developing roller. The remaining air bubbles are collapsed or blown out on the developing roller as the developing solution is delivered as a solution film on the developing roller toward the latent-image carrier upon rotation of the developing roller.

Since the developing solution is continuously supplied from the solution pool by the developing roller to the latent-image carrier, the developing solution can be uniformly supplied as long as the solution pool is present as a solution supply even if the developing solution is somewhat irregular in quantity in the solution pool between the developing roller and the scraper. Therefore, the arrangement of the present invention is free from the problem of an uneven supply of the developing solution to the latent-image carrier, which would otherwise result in a greater amount of the developing solution in the vicinity of the nozzle opening and a pregressively smaller amount thereof away from the nozzle opening.

Figure 3:
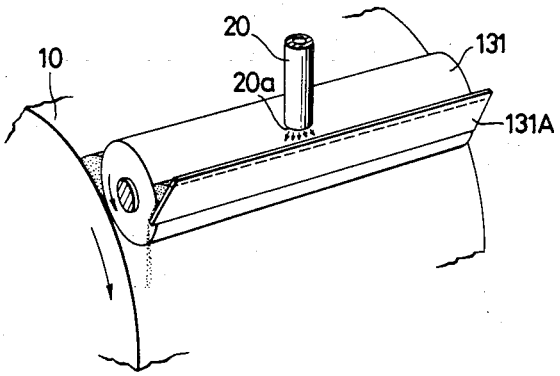
FIG. 3 is a perspective view of a first developing roller in the wet-type developing device.

It is however preferable that the quantity of the developing solution in the solution pool be as uniform as possible in the longitudinal direction of the developing roller. Therefore, as shown in FIG. 3, the nozzle opening **20*a* is located centrally of the first developing roller 131** in the longitudinal direction thereof.

The single solution supply nozzle 20 can supply the developing solution sufficiently and effectively. Where several solution supply nozzles are to be added, they should be positioned in a symmetrical pattern with respect to the longitudinally central position of the first developing roller 131, and the nozzles should be directed obliquely toward the above-mentioned longitudinal central position for forming a more uniform solution pool.

The developing solution supplied by the first developing roller 131 to the latent-image carrier 10 is then pooled between the first developing roller 131 and the latent-image carrier 10, and is then progressively transferred to the latent-image carrier 10 as it rotates. The developing solution is carried as a solution film on the latent-image carrier 10 past the second developing roller 132, which has an auxiliary solution supplying capability. The developing solution is then removed from the latent-image carrier 10 by the squeeze roller 133 and its scraper 133A and collected in a tank 22 through a collection pipe 21 connected between the container 130 and the tank 22 and opening at the bottom of the container 130. The nozzle 20 is supplied with the developing solution from the tank 22 through a supply pipe 23 by means of a pump P mounted on the tank 22. The pump P has a discharge pipe connected to the supply pipe 23 and also to a solution density sensor 24 and an agitating nozzle 25 which are position in the tank 22.

The scrapers 131A, 132A have openings in their longitudinal ends for allowing the developing solution to flow down from the solution pools. The developing solution flowing down from the scraper 131A is received by the scraper 132A, and the developing solution flowing down from the scraper 132A is received by the container 130. The scrapers 131A, 132A are slightly longer than the longitudinal dimensions of the developing rollers 131, 132 so as to serve as cleaning members. For example, each of the longitudinal ends of the scrapers 131A, 132A projects longitudinally beyond the corresponding end of the developing roller by a length ranging from 1 to 2 mm.

It is necessary that the solution pool be formed at all times between the developing roller and the associated scraper, and the solution pool be present in the longitudinal direction of the developing roller to the extent that the developing solution can be supplied evenly from the solution pool over the surface of the developing roller to the latent-image carrier so as not to cause a supply failure or developed-image irregularities at least in the area on the latent-image carrier where electrostatic latent images will be formed. The rate of supply of the developing solution through the solution supply nozzle 20 is determined taking into account the speed of rotation of the developing roller for feeding the developing solution from the solution pool, the viscosity of the developing solution, and other factors.

At least during the developing process, a developing bias voltage is applied to the developing rollers to prevent the sheet of copy paper from being undesirably smeared in its background area.

In an experimental example, the scrapers 131A, 132A were formed of a Mylar film having a thickness of about 250 mm, and the first and second developing rollers 131, 132 had a diameter of 22 mm. The developing rollers 131, 132 were rotated at a circumferential speed ranging from 200 to 300 mm/sec. to supply the developing solution having a viscosity ranging from 1.0 to 1.7 cp frm the solution supply nozzle 20 at a rate in the range of from 1,200 to 1,500 ml/min. A solution pool containing a suitable amount of developing solution was formed in the longitudinal diection of the developing roller 131, and an image was developed well by the developing solution supplied from such a solution pool.

Obviously, numerous modifications and variations of the present invention are possible in light of the above teachings. It is therefore to be understood that within the scope of the appended claims, the invention may be practiced otherwise than as specifically described herein.

What is claimed is:

1. A device for supplying a developing solution in a copying apparatus having a latent-image carrier, comprising:

(a) a first developing roller disposed closely to the latent-image carrier;

(b) a first scraper having a free end directed downwardly and held in contact with the circumferential surface of said first developing roller remotely from said latent-image carrier;

(c) means for downwardly supplying a developing solution to a first solution pool formed between said first scraper and the circumferential surface of said first developing roller;

(d) means for rotating said first developing roller about its own axis in a direction to move said circumferential surface of the first developing roller for drawing the developing solution upwardly out of said first solution pool and transferring it to said latent-image carrier to develop a latent image thereon with said developing solution;

(e) a second developing roller disposed closely to the latent-image carrier at a location below said first developing roller;

(f) a second scraper having a free end directed downwardly and held in contact with the circumferential surface of said second developing roller remotely from said latent-image carrier, said second developing roller and said scraper being disposed so as to receive developing solution overflowing from said first solution pool, thereby to form a second solution pool between said second developing roller and said second scraper;

(g) means for rotating said second developing roller about its own axis in a direction to move said circumferential surface of the second developing roller for drawing the developing solution upwardly out of said second solution pool and transferring it to said latent-image carrier to develop a latent image thereon with said developing solution.

2. A device according to claim 1, wherein said latent-image carrier is rotated at a constant speed in a fixed direction.

3. A device according to claim 2, wherein each said developing roller is positioned in confronting relation to said latent-image carrier in a region where the circumferential surface of said latent-image carrier moves downwardly, each said developing roller being rotatable in a sense opposite to the sense in which said latent-image carrier rotates.

4. A device according to claim 1, wherein the circumferential surface of each said developing roller is spaced 0.1 mm from the circumferential surface of said latent-image carrier.

5. A device according to claim 1, wherein each said developing roller has a diameter of 22 mm and is rotated about its own axis at a circumferential speed ranging from 200 to 300 mm/sec.

6. A device according to claim 5, wherein said developing solution has a viscosity ranging from 1.0 to 1.7 cp, and is supplied to said first solution pool at rate ranging from 1,200 to 1,500 ml/min.

7. A device according to claim 1, wherein said solution pools are respectively formed in spaces of a substantially V-shaped cross section between said scrapers and said circumferential surfaces of said developing rollers.

8. A device according to claim 7, wherein each said scraper is oriented in a direction opposite to the direction in which the surfaces of said developing rollers move against the scrapers.

9. A device according to claim 8, wherein each said scraper is longer than the axial length of its corresponding developing roller.

10. A device according to claim 9, wherein each end of each said scraper projects beyond the corresponding end of its corresponding developing roller in the axial direction thereof by a length ranging from 1 to 2 mm.

11. A device according to claim 7, wherein each said scraper has an opening in each of longitudinal ends thereof for allowing the developing solution to flow down from said first and second solution pools through said openings.

12. A device according to claim 1, wherein each said scraper is formed of a Mylar film having a thickness of about 250 mm.

13. A device according to claim 1, wherein said supplying means comprises a solution supply nozzle disposed substantially centrally of said first developing roller along its longitudinal axis.

14. A device according to claim 13, including a tank of the developing solution and a pump mounted on said tank, said solution supply nozzle being connected to said tank.

15. A device according to claim 1 said first and second developing rollers having primary and secondary image developing capabilities, respectively, for developing an image on said latent-image carrier with said developing solution.

16. A device according to claim 1, including a squeeze roler disposed below said second developing roller in confronting relation to said latent-image carrier.

17. A device according to claim 1, including a container covering at least said first and second developing rollers for collecting in its bottom the developing solution removed from said latent-image carrier after the image has been developed thereon, a tank of the developing solution, and a collection pipe connected between said container and said tank for collecting the developing solution from the bottom of said container therethrough in said tank.

18. A device according to claim 1, wherein the free end of each said scraper is held against the circumferential surface of its corresponding developing roller along its entire axial length for pooling the developing solution between each scraper and the corresponding developing roller and for clearing the developing solution off said developing rollers.

19. A device according to claim 1, wherein said supplying means comprises a nozzle having an opening disposed closely to an end of said first scraper opposite to said free end.

20. A device according to claim 1, wherein said supplying means comprises a nozzle having an opening disposed closely to said first solution pool.

* * * * *